United States Patent [19]

Hecht et al.

[11] Patent Number: 4,566,178

[45] Date of Patent: Jan. 28, 1986

[54] PROCESS FOR ASSEMBLING A CONE SPEAKER

[75] Inventors: William Hecht, Orange Park; Pablo Reyes, Jacksonville, both of Fla.

[73] Assignee: Phase Technology Corporation, Jacksonville, Fla.

[21] Appl. No.: 687,444

[22] Filed: Dec. 28, 1984

[51] Int. Cl.[4] ..... H04R 31/00

[52] U.S. Cl. ..... 29/594; 179/115.5 R; 179/115.5 PC; 179/115.5 VC

[58] Field of Search ..... 29/594, 602 A; 179/115.5 R, 115.5 ES, 115.5 E, 115.5 PC, 115.5 VC

[56] References Cited

U.S. PATENT DOCUMENTS 4,479,035 10/1984 Philippbar ..... 29/594 X

*Primary Examiner*—Carl E. Hall

*Attorney, Agent, or Firm*—Arthur G. Yeager

[57] ABSTRACT

A process for assembling a cone speaker by the consecutive steps of (a) attaching a forward ring-shaped magnet plate to the small end of a truncated conical basket frame; (b) attaching a ring-shaped magnet concentrically to the forward magnet plate; (c) positioning voice coil by a shim within the central opening of the forward magnet plate; (d) affixing a flexible spider to the voice coil and to the basket; (e) affixing a solid speaker cone and its flexible skiver to the voice coil and to the basket; and affixing a cylindrical pole piece and rear plate assembly to the rear portion of the magnet with the pole piece extending into the inside of the voice coil and spaced apart therefrom by about 0.015 inch radially.

16 Claims, 12 Drawing Figures

PROCESS FOR ASSEMBLING A CONE SPEAKER

BACKGROUND OF THE INVENTION

Cone speakers for reproducing sound are well known and have as common components a voice coil which is positioned axially within a central passageway of a magnet assembly so as to move axially in response to electro-magnetic impulses. A speaker cone is attached to the voice coil and moves with the movement of the voice coil to produce sound waves. Usually, these components are assembled by positioning the voice coil in the central opening of the magnet assembly by means of a shim and then attaching the spider and the cone before the shim is removed through the forward opening of the cone. A dust cap is then affixed to the cone over the voice coil opening to protect same from dust and debris. In accord with the present invention, the cone is solid and there is no possibility of removing the shim through the solid cone and therefore the prior art process is not applicable to manufacture of this type of speaker or transducer.

It is an object of this invention to provide a novel process for assembling a cone speaker. It is another object of this invention to provide a novel process for centering the voice coil and the magnet pole piece in a speaker. Still other objects will become apparent from the more detailed description hereinafter set forth.

BRIEF DESCRIPTION OF THE INVENTION

This invention relates to processes for assembling cone speakers which include:

(A) attaching a truncated conical basket frame to a flat ring-shaped forward magnet plate having a central round opening and attaching to the forward plate a flat ring-shaped magnet with its opening being larger than and generally concentric to the central opening of the forward plate;

(B) inserting into the central opening a voice coil of electric wire wrapped around the rearward portion of a tubular bobbin and spaced apart concentrically within the central opening by a shim means for accurately spacing the bobbin and voice coil;

(C) attaching the inside of a ring-shaped, flexible spider to the outside of the bobbin and the outside of the spider to the frame;

(D) attaching a truncated speaker cone at its small face to the forward end of the bobbin and its large face connected to the inner edge of a flexible skiver which is attached at its outer edge to the frame;

(E) removing the shim means through the central opening and the opening of the magnet;

(F) inserting into the opening of the magnet and into the inside of the bobbin the pole piece of a rearward magnet plate including a rear plate and a cylindrical pole piece projecting outwardly from one side of the rear plate, the pole piece being spaced apart concentrically from the inside of the bobbin by about 0.015 inch radially; and (G) attaching the rear plate to the upper face of the magnet.

The process additionally include within (D) above:

(H) inserting the forward end of the bobbin into a mating recess in the body of the solid speaker cone; and (I) gluing the bobbin to the speaker cone within the mating recess; also, the process includes:

(J) turning over the partially assembled speaker in accord with steps (A)–(D) 180° to position the partially assembled speaker with its backward face upwardly, prior to (E) above. Furthermore, prior to (F) above, the process includes:

(K) inserting a tubular hollow fixture into the central opening for positioning the pole piece at a selected centralized spacing within the central opening;

(L) temporarily removing the pole piece;

(M) removing the fixture; and (N) performing (F) above without changing the relative rotation or the aligned and selected centralized spacing of the pole piece in the central opening of the forward plate.

Specifically, the pole piece and fixture are removed by:

(O) powering an electromagnet attached to the support for temporarily attracting and holding the rear plate and pole piece during withdrawal and reinsertion; and thereafter;

(P) depowering the electromagnet to cause release of the rear plate with the pole piece in its selected centralized spacing.

The process includes:

(R) rotating the partially assembled speaker while simultaneously applying glue to the upper face of the magnet; and (S) precisely stopping the rotation of the partially assembled speaker so that the pole piece can be accurately repositioned inside of the bobbin.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
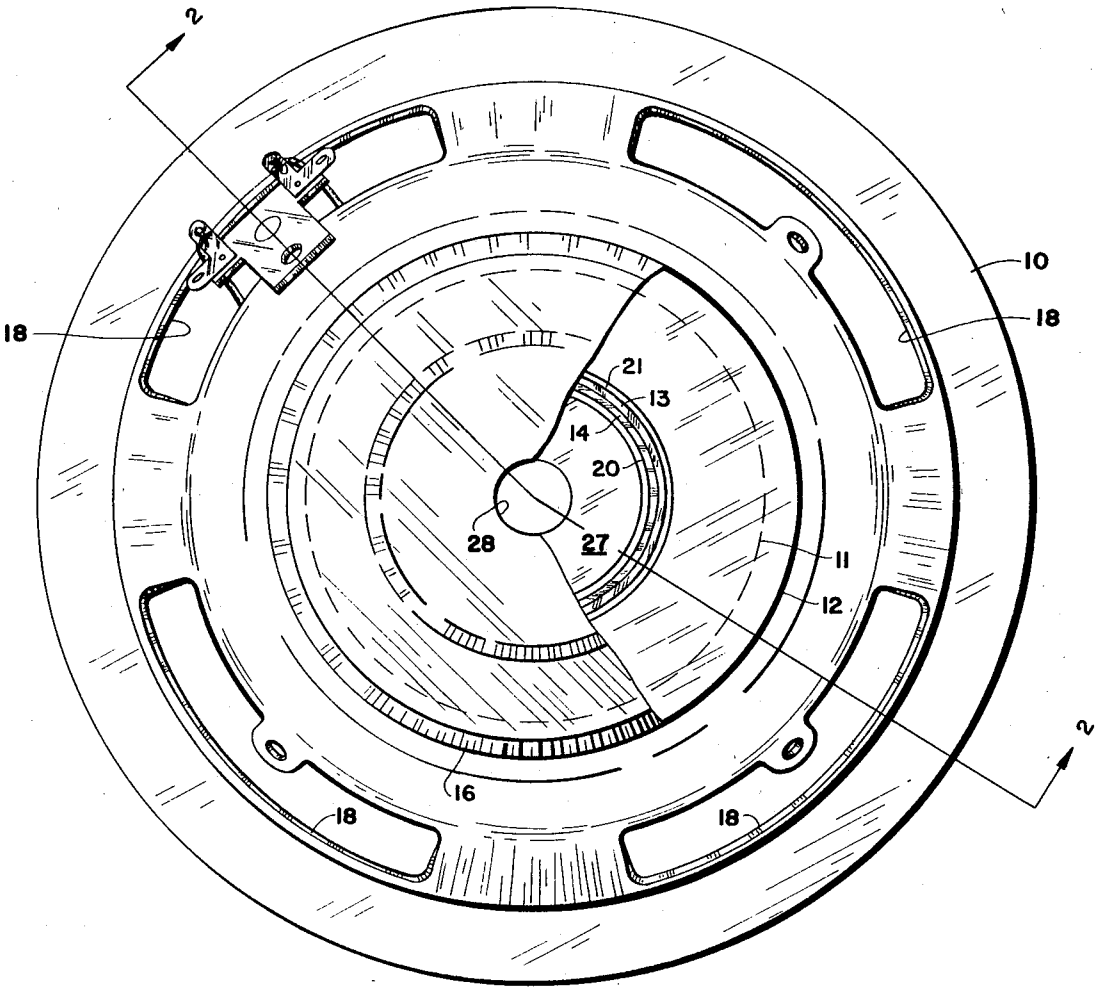
FIG. 1 is a top plan view of the cone speaker assembled by the process of this invention.
Figure 3:
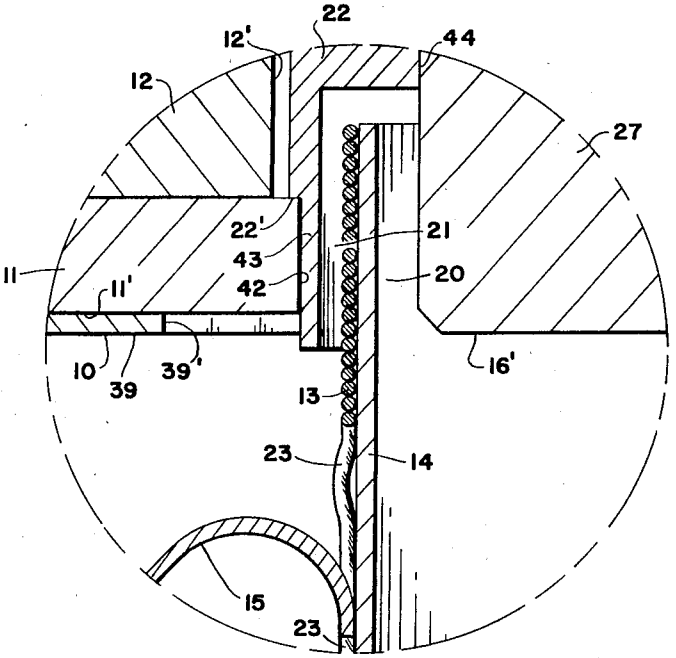
FIG. 3 is an enlarged view of the portion identified by numeral 3 of FIG. 2.
Figure 2:
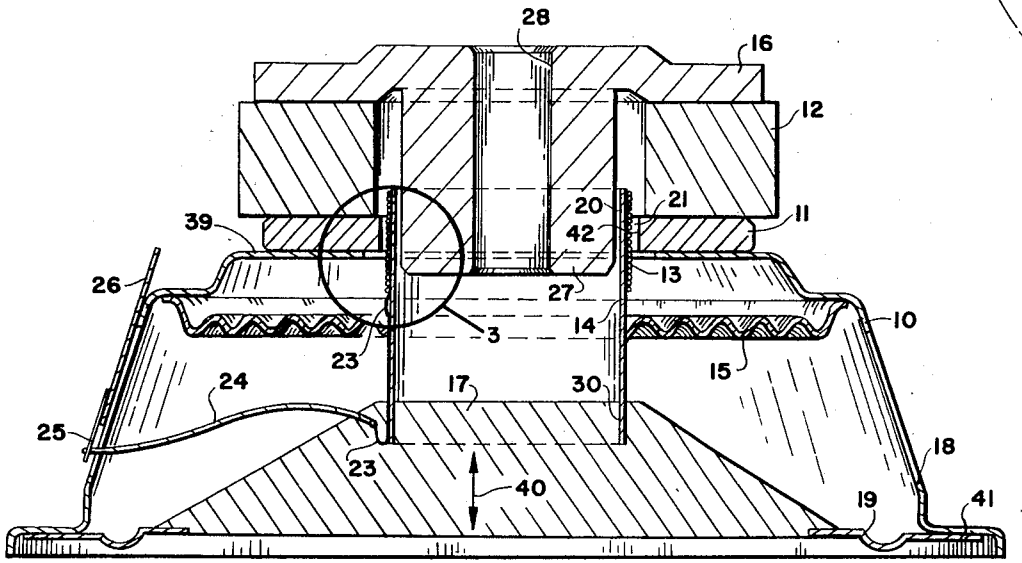
FIG. 2 is a cross sectional view taken at 2—2 of FIG. 1.

The component parts of the cone speaker which is assembled by the process of this invention are best understood by reference to FIGS. 1–3. A basket frame 10 comprises the supporting structure for the assembled speaker. Frame 10 comprises the supporting structure for the assembled speaker. Frame 10 is preferably in the shape of a truncated cone and is made of stamped sheet metal, alloy casting or molded plastic having open areas or windows 18 to lighten the weight of the structure and to permit the free movement of the air behind the cone 17. On the rearward end of frame 10 is welded a forward magnet plate 11 to which a magnet 12 is glued and a rearward magnet plate 16 is glued. The forward magnet plate 11 to which a magnet 12 is glued and a rearward magnet plate 16 is glued. The forward magnet plate 11 and magnet 12 have respective central openings 42 and 12' in substantial concentric alignment for reception thereinto of the pole piece 27. The forward magnet plate 11 is generally concentrically around a central opening 39' in rear wall 39 of frame 10. Centrally of the concentric arrangement a pole piece 27, which preferably is an integral part of, and projects forwardly from, rear magnet plate 16 and terminates substantially at the lower surface 11' of forward magnet plate 11 as seen in FIG. 3. This concentric arrangement results in a tubular air space 20 between the outside surface of pole piece 27 and the inside surface of forward magnet plate 11. In this tubular air space 20 voice coil 13 is mounted on bobbin 14 and positioned so as not to contact, but to clear uniformly, through its limited movement, front magnet plate 11 and pole piece 27. For example, the inside of the voice coil 13 is spaced about 0.010–0.015 inch from the outside of pole piece 27 and likewise from the opening 42 in the forward magnet plate 11. Voice coil 13 and its supporting bobbin 14 is attached to the small end, the rearward portion, of the solid cone 17, which may be of a light weight foamed plastic material or the like. A ring shaped recess 30 is formed into cone 17 and voice coil assembly 13, 14, is inserted into recess 30 and glued. Wire ends 23 from voice coil 13 are connected by soldering or the like to flexible lead wires 24 which are connected to terminal strip 25 from which the speaker may be connected to an audio system. Cone 17 is maintained by a surround or skiver 19 which flexibly joins the forward face of cone 17 to the forward rim 41 of basket frame 10. Skiver 19 is preferably made of thin foam, rubber or fabric that is glued both to cone 17 and to frame 10. The middle portion of bobbin 14 is glued to the inside edge of spider 15, which in turn, is glued at its outside edge to frame 10. Spider 15 is formed as a plurality of concentric accordion pleats to accommodate the combined movement of voice coil 13, bobbin 14, and cone 17. Signals received through lead wires 24 to voice coil 13 cause changes in the field of the magnet assembly in the air space around voice coil 13. The changes in the magnetic field cause voice coil 13, bobbin 14, and cone 17 to move back and forth in the direction of arrow 40 resulting in the production of sound waves.

In the prior art, the cone is a hollow cone made of paper or plastic joined at the rearward end (small end of the cone) to voice coil bobbin 14 and at the forward end (large end of the cone) to the rim 41 of basket frame 10. This permitted the assembly of voice coil 13 and its bobbin 14 through the inside of the hollow speaker cone. Shims could be installed to position bobbin 14 properly and be removed through the forward openings of the hollow cone followed by a dust covering glued over such opening. Shims from solid speaker cones cannot be removed and thus cannot be manufactured in accord with prior art methods. Considerable difficulties have been encountered in making a solid cone speaker and in properly assembly of the voice coil from the rearward end of the speaker through magnet 12 with the appropriate spacing between components which must be assembled concentrically without any contact.

Figure 4:
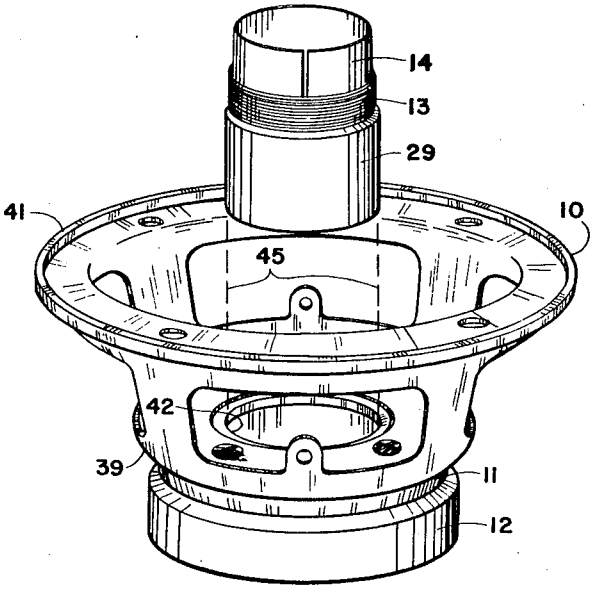

In FIGS. 4–12 there are shown graphically the steps of the process of this invention in assembling a cone speaker. In FIG. 4 there is shown basket frame 10 which has previously been attached by welding or swaging to the forward magnet plate 11, which is attached by gluing to magnet 12. Magnet 12 and forward magnet plate 11 are both ring shaped with central circular openings. These three components (10, 11 and 12) are assembled so that the central openings in each component are essentially concentric with respect to the other two. The assembled basket 10, plate 11, and magnet 12 is placed on a table with magnet 12 downward and the open face (large end) of basket frame 10 upward. Voice coil 13 on bobbin 14 is inserted into the opening 42 in the forward magnet plate 11 in the direction of the broken lines and arrows 45 and positioned concentrically by shim means 29 which maintains voice coil 13 in a spaced uniform relationship with respect to the opening 42 in forward magnet plate 11. Shim means 29 may be a precisely formed tube or a flat sheet material formed into a cylindrical shape which fits closely over the outside of the voice coil 13 and the opening 42 of forward magnet plate 11.

Figure 5:
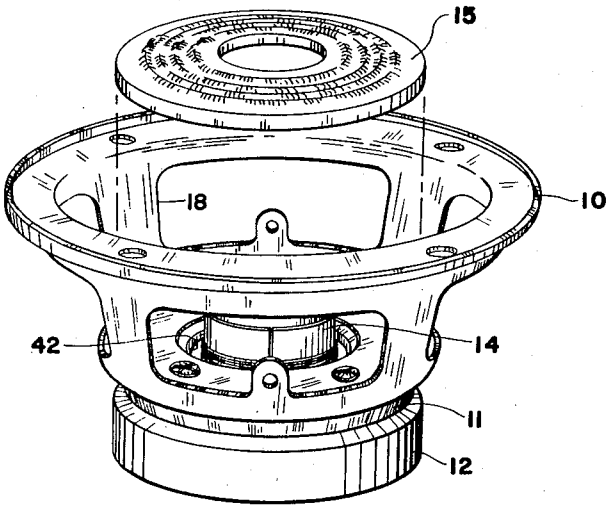

In FIG. 5 the above assembly is in place with the forward end of bobbin 14 projecting upwardly from opening 42 of forward magnet plate 11. Spider 15 is placed around and glued at its inner edge to bobbin 14 and at its outer edge to basket 10.

Figure 6:
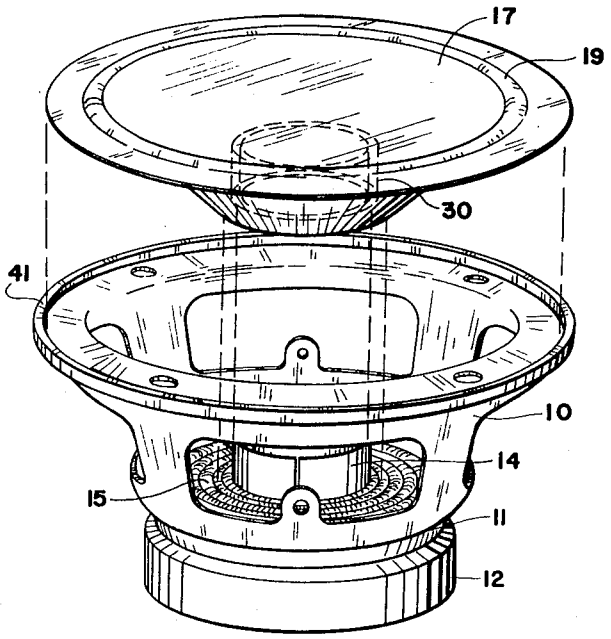
FIGS. 4–12 are perspective views of the consecutive steps of the process of this invention for assembling a cone speaker.

In FIG. 6 the solid cone 17, with a previously attached flexible skiver 19 around its larger face and with recess 30 in its smaller face, is lowered and the upwardly projecting end of bobbin 14 is received within recess 30. Glue is applied to attach cone 17 to bobbin 14 and also to attach connector ring 19 to rim 41 of frame 10.

Figure 7:
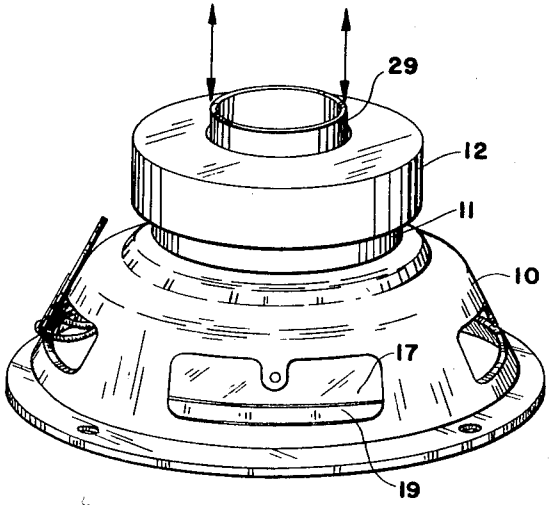

In FIG. 7 the partially assembled speaker is turned 180° upside down or over so that rim 41 and skiver 19 are facing downward and magnet 12 is facing upward. Shim 29 is then removed through the opening 12' in magnet 12.

Figure 8:
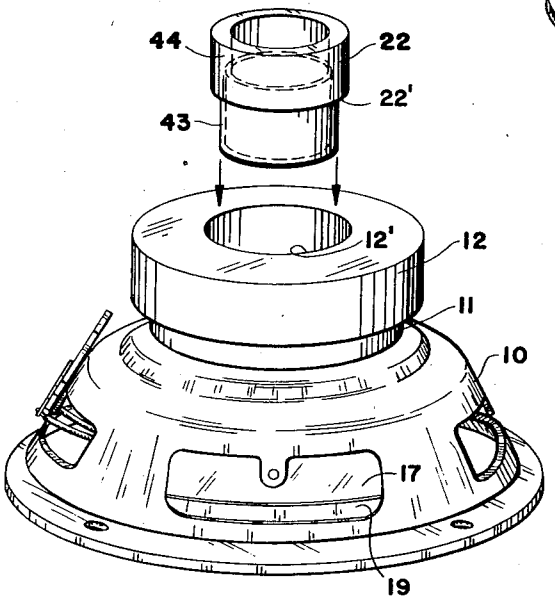

In FIG. 8 a precisely machined centering tubular shim or fixture 22 is inserted in the opening 12' of magnet 12 and into opening 42 of forward magnet plate 11. Fixture 22 has a smooth machined outer cylindrical surface to closely fit the inside surface of the opening 42 in forward magnet plate 11. The inside surface of fixture 22 is a stepped pair of concentric cylindrical surfaces. Forward portion 43 of fixture 22 is of appropriate thickness to closely fit in the spacing between the inside surface of the forward magnet plate 11 and readily clear the outside surface of voice coil 13. Rearward portion 44 is of the appropriate thickness to closely fit over the outside surface of pole piece 27 which must be accurately spaced about 0.015 inch from the inside surface of voice coil bobbin 14. Fixture 22 must therefore, be very precisely machined to minimal tolerances. The relationships of the forward magnet plate 11, voice coil 13, bobbin 14, pole piece 27, and fixture 22 may be best understood by reference to the enlarged view of FIG. 3.

Figure 9:
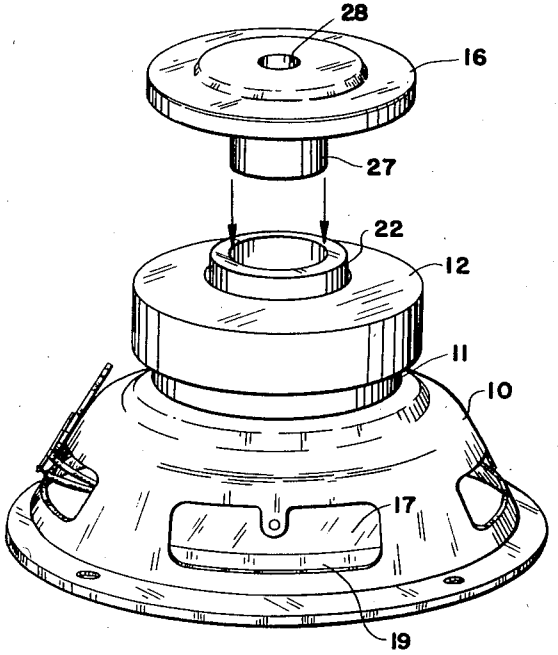

In FIG. 9, rearward magnet plate 16 with pole piece 27 integral therewith is lowered into the central opening of fixture 22 which will position pole piece 27 precisely with respect to its spacing from voice coil bobbin 14.

Figure 10:
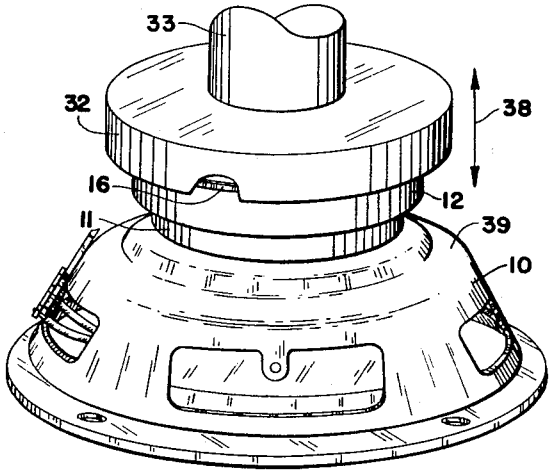

In FIG. 10 there is shown a vertically reciprocating means which can be releasably attached to rearward magnet plate 16. A preferred reciprocating means is an electromagnetic head 32 attached to a support 33 which is capable of moving vertically in the direction of arrow 38. Head 32 with no electromagnetic power is lowered until it touches the upper surface of rearward magnet plate 16. With power supplied, a magnetic field causes plate 16 to be attracted to and attached to head 32.

Figure 11:
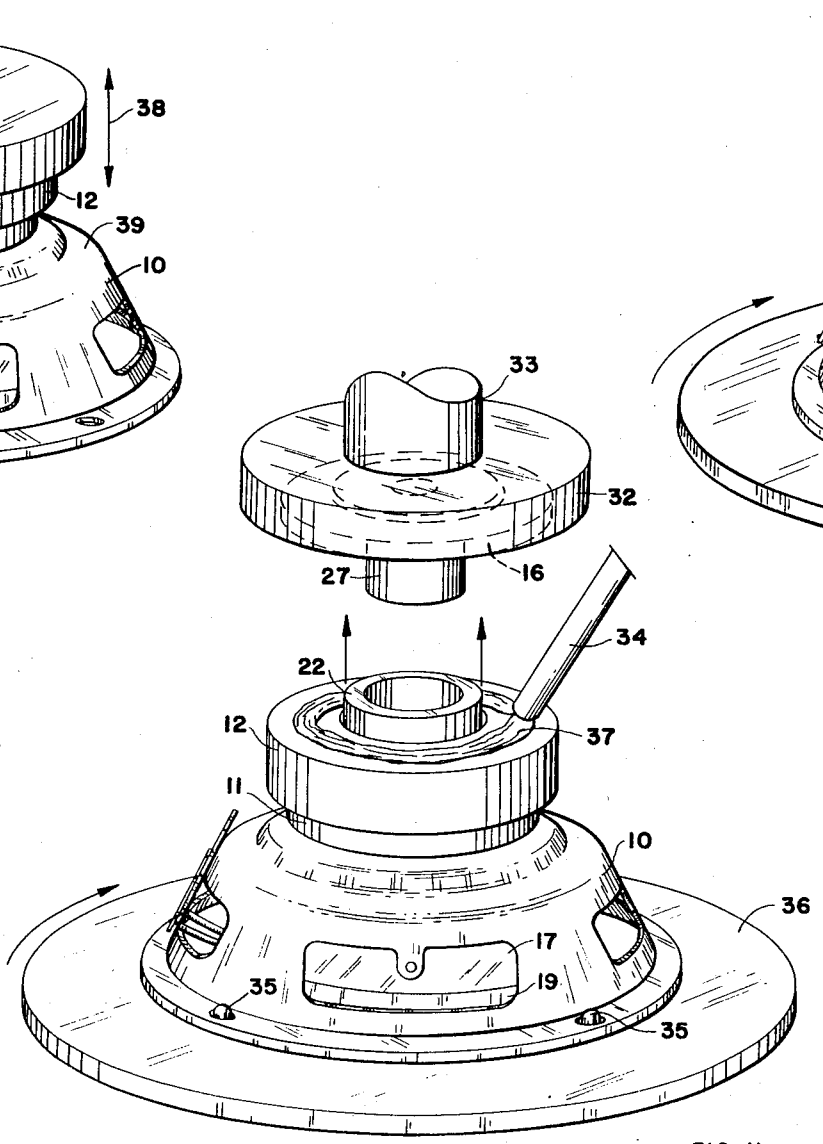

In FIG. 11, support 33 is moved upward along with head 32 and rearward magnet plate 16 attached thereto. With plate 16 and pole piece 27 withdrawn, fixture 22 may be removed and glue applied to the exposed upper surface of magnet 12. One method of applying glue is to employ a rotating table 36 on which the speaker assembly may be attached by pins 35 attached to table 36 which mate with holes in basket frame 10. Rotating table 36 preferably would be the table employed when the speaker assembly was turned over for the step described with respect to FIG. 7. Rotating table can then be rotated to permit quick and accurate application of glue to magnet 12 by applicator 34, which may be by an air operated glue dispenser, a brush, a roller or other means, as illustrated in FIG. 11. Of course, if table 36 does not revolve, the glue applicator 34 must move about the exposed upper surface of magnet 12, or a ring applicator for the glue could be employed to simultaneously apply a ring of glue to the upper surface of magnet 12.

Figure 12:
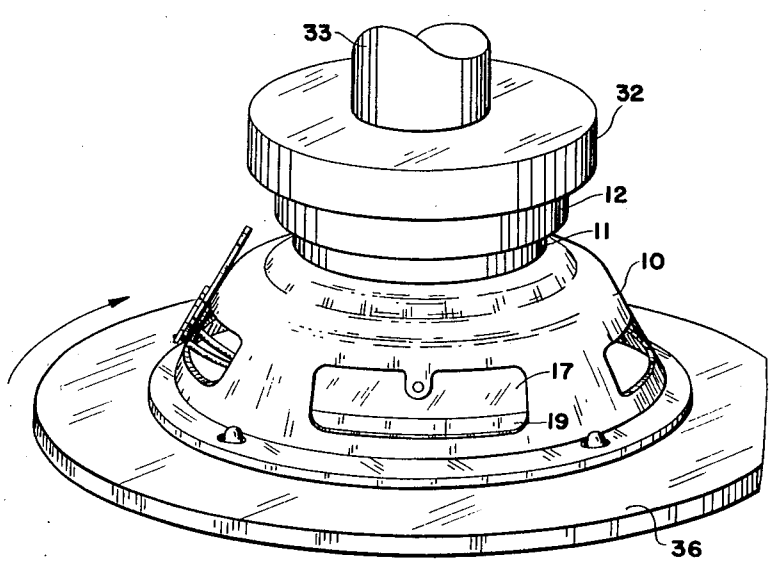

In FIG. 12 the assembly is completed by reversing the movement of support 33 and electromagnetic head 32 and returning rear magnet plate 16 and pole piece 27 into contact with magnet 12 to be fixed in place by the glue so applied in FIG. 11. The reciprocating movement of support 33 must be sufficiently precise to return pole piece 27 to its original spacing and rotative orientation inside of voice coil bobbin 14 when support 33 moves downward to the position shown in FIG. 12. A precise reciprocating support 13 might be a computer controller structure set to return precisely to the position originating in FIG. 10 or it might be a precision vertical mover similar to a drill press or other movable platen. The important consideration is for the pole piece 27 to be returned to a position in which the spacing previously established by the shim means 29 with respect to the coil 13 and bobbin 14, and fixture 22 with respect to pole piece 27, be maintained. Of course, after the pole piece 27 is in its original position, the electromagnetic head 32 is de-powered and again support 33 is raised completing the assembly of the speaker as shown in FIGS. 1–3, whereupon such speaker may be removed from table 36 to a position in which the glue is permitted to become substantially fully dried or cured.

It is to be noted that fixture 22 includes a shoulder 22' which engages the edge defining the opening 42 of forward magnet plate 11 to prevent contact of fixture 22 with the upper end of bobbin 14 as seen in FIG. 3. The spacing between pole piece 27 and bobbin 14 as well as that between the forward plate 11 and coil 13 should be equal and be about 0.015 inch.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A process for assembling a cone speaker which comprises the steps of:

(1) attaching a truncated conical basket frame, having a open forward face and a closed rearward face with a passageway therethrough, to a flat ring-shaped forward plate having its central round opening smaller than and concentric to the passageway, and attaching to the forward plate a flat ring-shaped magnet with its central opening larger than and generally concentric to the central opening of the forward plate;

(2) inserting into the central opening of the forward plate a voice coil of electric wire wrapped spirally around the rearward portion of a tubular bobbin and spaced apart concentrically within the central opening of the forward plate by a removable voice coil shim means for accurately spacing the bobbin and voice coil;

(3) attaching the inside of a ring-shaped, flexible spider to the outside of the voice coil bobbin and the outside of the spider to the frame;

(4) attaching a truncated speaker cone at its small face to the forward end of the voice coil bobbin and its large face connected to the inner edge of a flexible skiver which is attached at its outer edge to the open forward face of the frame;

(5) removing the voice coil shim means through the central opening of the forward magnet plate and the central opening of the magnet;

(6) inserting into the central opening of the magnet and into the inside of the tubular coil bobbin the pole piece of a rearward magnet plate comprising a rear plate and a cylindrical pole piece projecting outwardly from one side of the rear plate, the pole piece being spaced apart concentrically from the inside of the bobbin by about 0.015 inch radially; and (7) attaching the rear plate to the upper face of the magnet.

2. The process of claim 1 wherein the step (4) includes the steps of:

(7) inserting the forward end of the bobbin into a mating recess in the body of the speaker cone; and (8) gluing the bobbin to the speaker cone.

3. The process of claim 1 wherein the step (4) includes the steps of:

(7) inserting the forward end of the bobbin into a mating recess formed into the solid body of the speaker cone; and (8) gluing the bobbin in the mating recess.

4. The process of claim 1 wherein the following step is prior to step (5):

(8) turning over the partially assembled speaker in accord with steps (1)–(4) 180° to position the partially assembled speaker with its backward face upwardly.

5. The process of claim 4 wherein the following steps are prior to step (6):

(9) inserting a tubular hollow fixture into the central opening of the forward plate for positioning the pole piece at a selected centralized spacing within the central opening of the forward plate;

(10) temporarily removing the pole piece;

(11) removing the fixture; and

(12) performing step (6) without changing the relative rotation or the aligned and selected centralized spacing of the pole piece with respect to the central opening of the forward plate.

6. The process of claim 1 wherein the following steps are prior to step (6):

(8) inserting a tubular hollow fixture into the central opening of the forward plate for positioning the pole piece at a selected centralized spacing within the central opening of the forward plate;

(9) inserting the pole piece within the fixture;

(10) withdrawing the pole piece and maintaining the pole piece in its same relative rotative and vertically aligned position with respect to the central opening of the forward plate to be reinserted in step (6) with the selected spacing; and

(11) withdrawing the fixture.

7. The process of claim 6 wherein step (9) includes the step of (12) temporarily attaching a support to the rear plate to facilitate the precise withdrawal and reinsertion of the pole piece in the bobbin after removal of the fixture.

8. The process of claim 7 wherein said step (12) includes the steps of:

(13) powering an electromagnet attached to the support for temporarily attracting and holding the rear plate and pole piece during said withdrawing step (9) and the inserting step (6); and

(14) depowering the electromagnet to cause release of the rear plate with the pole piece in its selected centralized spacing.

9. The process of claim 8 wherein the following steps are after step (11):

(14) rotating the partially assembled speaker while simultaneously applying glue to the upper face of the magnet;

(15) precisely stopping the rotation of the partially assembled speaker so that the pole piece can be accurately repositioned inside of the bobbin in accord with steps (6) and (10).

10. The process of claim 1 wherein the following steps are prior to step (6):

(8) temporarily inserting a fixture to establish the position of the pole piece within the central opening of the forward plate;

(9) temporarily inserting into and accurately removing the pole piece from the fixture;

(10) removing the fixture; and

(11) precisely returning the pole piece into its previous position within the bobbin in accord with step (6).

11. A process for assembling a solid cone speaker which comprises the steps of:

(1) affixing a truncated conical basket frame, having an open forward face and a closed rearward face with a passageway through the forward and rearward faces, rigidly to a flat ring-shaped forward plate having its central opening smaller than and concentric to the passageway, and gluing to the forward plate a flat ring-shaped magnet with its central opening larger than and generally concentric to the central opening of the forward plate;

(2) inserting into the central opening of the forward plate a voice coil wrapped around the rearward portion of a tubular bobbin and spaced apart concentrically within the central opening of the forward plate by a removable shim means for accurately spacing the bobbin and voice coil;

(3) gluing the inside edge portion of a ring shaped, flexible spider to the outside surface of the bobbin and the outside edge portion of the spider to the frame;

(4) attaching a solid truncated speaker cone adjacent its small face to the forward end portion of the bobbin and its large face being affixed to the inner edge portion of a flexible skiver which is glued at its outer edge portion to the open forward face of the frame;

(5) removing the voice coil shim means through the opening of the forward plate and the central opening of the magnet;

(6) inserting a hollow tubular fixture having an outside diameter substantially equal to the inside diameter of the central opening in the forward plate and an inside diameter adjacent its rearward end portion substantially equal to the outside diameter of the pole piece and an inside diameter at the rearward end of said spacer to readily clear the outside diameter of the wrapped voice coil about the bobbin;

(7) inserting into the hollow fixture and the tubular bobbin the pole piece of a rear plate carrying the pole piece projecting outwardly from one side thereof and the pole piece having an outside diameter substantially equal to the inside diameter of the hollow fixture and less than the inside diameter of the hollow bobbin;

(8) temporarily removing the rearward plate and the pole piece from the hollow fixture;

(9) removing the hollow fixture from the central opening of the forward plate;

(10) replacing the rear plate with its pole piece inside the tubular bobbin in the same spaced relationship from the central opening of the forward plate and from the inside surface of the hollow bobbin, as in said step (6); and

(11) attaching the rear plate to the upper face of the magnet.

12. The process of claim 11 wherein step (8) includes the steps of:

(12) temporarily attaching a reciprocating support to the rear plate and pole piece;

(13) moving the support upwardly to withdraw the rear plate and pole piece; and

(14) detaching the reciprocating support from the rear plate after said steps (9)–(11).

13. The process of claim 12 wherein said step (13) is moved vertically without any relative rotation of the rear plate and the pole piece.

14. The process of claim 13 wherein said step (13) includes the steps of:

(15) powering an electromagnet attached to the support for temporarily attracting and holding the rear plate and pole piece during said step (13) and step (10); and

(16) depowering the electromagnet to cause release of the rear plate with the pole piece in its previous position set forth in said steps (7) and (10).

15. The process of claim 11 wherein step (4) includes the steps of:

(12) inserting the forward end portion of the bobbin into a mating recess in the body of the solid speaker cone; and

(13) gluing the bobbin forward end portion to the speaker cone.

16. The process of claim 11 wherein the following step is prior to step (6):

(12) turning over the partially assembled speaker in accord with steps (1)–(4) 180° to position same with its backward face upwardly.

* * * * *